US009614328B2

(12) United States Patent
Feldner

(10) Patent No.: US 9,614,328 B2
(45) Date of Patent: Apr. 4, 2017

(54) LOCKING DEVICE FOR A PLUG-IN CONNECTION

(71) Applicant: PHOENIX CONTACT E-MOBILITY GMBH, Schieder (DE)

(72) Inventor: Ralf Feldner, Detmold (DE)

(73) Assignee: Phoenix Contact E-Mobility GmbH, Schieder (DE)

( * ) Notice: Subject to any disclaimer, the term of this patent is extended or adjusted under 35 U.S.C. 154(b) by 0 days.

(21) Appl. No.: 14/767,899

(22) PCT Filed: Feb. 14, 2014

(86) PCT No.: PCT/EP2014/052900

§ 371 (c)(1),
(2) Date: Aug. 13, 2015

(87) PCT Pub. No.: WO2014/125065

PCT Pub. Date: Aug. 21, 2014

(65) Prior Publication Data

US 2015/0372421 A1 Dec. 24, 2015

(30) Foreign Application Priority Data

Feb. 14, 2013 (DE) ..... 10 2013 101 492

(51) Int. Cl.
*H01R 13/639* (2006.01)

(52) U.S. Cl.
CPC ..... *H01R 13/639* (2013.01); *H01R 13/6397* (2013.01)

(58) Field of Classification Search
USPC ..... 439/345, 347, 310, 358, 188, 133, 352, 439/304
See application file for complete search history.

(56) References Cited

U.S. PATENT DOCUMENTS 5,558,533 A * 9/1996 Hashizawa ..... B60L 11/1818 439/310
5,639,256 A * 6/1997 Endo ..... B60L 11/1818 439/353

(Continued)

FOREIGN PATENT DOCUMENTS

CN 104812611 7/2015
DE 10 2012 022413 B3 2/2014

(Continued)

OTHER PUBLICATIONS

Office Action issued Sep. 1, 2016 in corresponding China Application No. 201480008995.4 (5 pages).

(Continued)

*Primary Examiner* — Alexander Gilman
(74) *Attorney, Agent, or Firm* — Knobbe, Martens, Olson & Bear LLP

(57) ABSTRACT

The invention relates to a locking device for a plug-in connection between a plug and a socket. In accordance with the invention an actuator (4) and a blocking slide (6) are provided, wherein the actuator (4) is rotatable about an axis of rotation, the blocking slide (6) is displaceable in the longitudinal direction thereof between an unlocking position and a locking position, and the actuator (4) and the blocking slide (6) are formed in such a way and interact with each other such that a rotation of the actuator (4) is always combined with a longitudinal displacement of the blocking slide (6) and vice versa, wherein a longitudinal displacement of the blocking slide (6) by means of a rotation of the actuator (4) is always possible, whereas a rotation of the actuator (4) by means of a longitudinal displacement of the blocking slide (6) is possible only outside the locking position. A locking device of this type for a plug-in connection between a plug and a socket is thus provided, which (Continued)

Figure 1:
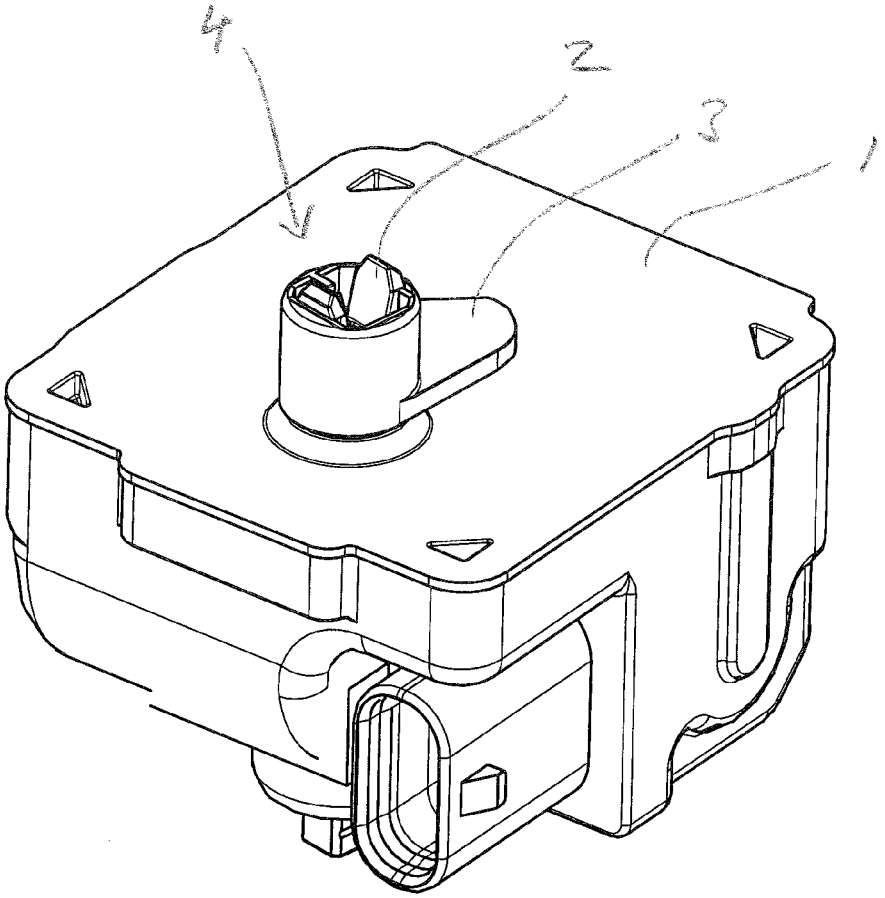

enables simple and economical axial locking, which cannot be manipulated.

8 Claims, 5 Drawing Sheets

(56) References Cited

U.S. PATENT DOCUMENTS 6,225,153 B1 * 5/2001 Neblett ..... B60L 11/1818 438/188
7,402,056 B2 * 7/2008 Lutsch ..... H01R 13/743 439/157
7,404,720 B1 * 7/2008 Frey ..... H01R 13/701 439/133
8,206,171 B2 * 6/2012 Osawa ..... H01R 13/502 439/352
8,568,155 B2 * 10/2013 Sebald ..... B60L 11/1818 439/304
9,106,015 B2 * 8/2015 Ohmura ..... H01R 13/6275
2011/0300736 A1 * 12/2011 Katagiri ..... B60L 11/14 439/347

FOREIGN PATENT DOCUMENTS

WO WO 2012/159950 A1 11/2012
WO WO 2013/117712 A2 8/2013

OTHER PUBLICATIONS

Search Report issued Sep. 1, 2016 in corresponding China Application No. 201480008995.4 (1 page).
International Search Report issued on May 20, 2014 in International Application No. PCT/EP2014/052900.
Office Action issued by the German Patent Office on Sep. 9, 2013 in German Application No. 10 2013 101 4925.

* cited by examiner

LOCKING DEVICE FOR A PLUG-IN CONNECTION

CROSS-REFERENCE TO RELATED APPLICATION

The present application is the U.S. National Phase under 35 U.S.C. §371 of International PCT application number PCT/EP2014/052900, filed Feb. 14, 2014, which claims priority to German Application No. 10 2013 101 492.5, filed Feb. 14, 2013, the contents of which are incorporated herein by reference in their entirety.

The invention relates to a locking device for a plug-in connection between a plug and a socket.

In the field of electromobility (e-mobility) various plug-in charging systems are known for the power supply of electrically operated vehicles. These are used for example for charging from the AC mains network or for quick charging using direct current.

Here, charging sockets of the type having a locking mechanism such that a charging plug cannot be detached during the charging are also known. Locking mechanisms of this type often act radially in a recess on the corresponding plug. However, standard IEC 62196 for "type 1 plugs" requires axial locking.

A frequent problem with axial locking mechanisms, however, is that these can push back. With use of an axial locking mechanism of this type, this may result in manipulation of the charging socket on a car. In spite of locking from the car side, a charging plug could be stolen, or the charging process could be interrupted unlawfully.

The object of the invention is to specify a locking device of this type for a plug-in connection between a plug and a socket, which locking device enables simple and economical axial locking that cannot be manipulated.

This object is achieved by the subject matter of Claim 1. Preferred developments are specified in the dependent claims.

In accordance with the invention a locking device for a plug-in connection between a plug and a socket is thus provided, comprising an actuator and a blocking slide, wherein the actuator is rotatable about an axis of rotation, the blocking slide is displaceable in the longitudinal direction thereof between an unlocking position and a locking position, and the actuator and the blocking slide are formed and interact with each other in such a way that a rotation of the actuator is always combined with a longitudinal displacement of the blocking slide and vice versa, wherein a longitudinal displacement of the blocking slide by means of a rotation of the actuator is always possible, whereas a rotation of the actuator by means of a longitudinal displacement of the blocking slide is possible only outside the locking position.

An essential point of the invention is therefore that of providing the locking device with a combination of this type of an actuator and a blocking slide, with which a movement of one component always also causes a movement of the other component. It is then essential here that the blocking slide can always be driven via the actuator, irrespective of the position in which the blocking slide is located. This means that the blocking slide can always be brought by means of the actuator from the unlocking position into the locking position and vice versa. By contrast, a movement of the actuator by means of the blocking slide and therefore also a movement of the blocking slide itself can then only be achieved when the blocking slide is located outside the locking position. This ensures that an influence on the blocking slide in the locking position cannot cause any rotation of the actuator, whereby no displacement of the blocking slide itself is permitted either. As a result of the invention a completely new way is found for attaining protection against manipulation for the blocking slide via the interaction thereof with the actuator, without the need for additional devices.

For the embodiment of actuator and blocking slide and for the interaction thereof in the sense of the invention, there are now various possibilities. In accordance with a preferred development of the invention the actuator has a drive plate, the drive plate has a first movement transfer device and a second movement transfer device, the blocking slide likewise has a first movement transfer device and a second movement transfer device, the first movement transfer device of the drive plate interacts with the first movement transfer device of the blocking slide, and the second movement transfer device of the drive plate interacts with the second movement transfer device of the blocking slide. Due to this division into two parts, via which the interaction between actuator on the one hand and blocking slide on the other hand is provided, it is possible to select the functions of these interactions such that, ultimately, no rotation of the actuator is enabled in the locking position via a longitudinal displacement of the blocking slide, whereas conversely in the same position, i.e. in the locking position, a movement from the locking position into the unlocking position can be initiated nevertheless via the actuator.

The various movement transfer devices can now be formed differently. In accordance with a preferred development of the invention the first movement transfer device of the drive plate and the first movement transfer device of the blocking slide are formed and arranged relative to each other in such a way that their interaction in the locking position is cancelled insofar as no rotation of the drive plate can be attained by means of the blocking slide. This means that no force can be exerted onto the drive plate by means of manipulation of the blocking slide, and therefore the system as a whole cannot be moved and therefore a movement of the blocking slide itself is also inhibited.

In accordance with a preferred development of the invention, the first movement transfer device of the drive plate furthermore is a cam, the first movement transfer device of the blocking slide is a link, and the cam is received in the link. Due to a rotation of the drive plate, the cam thus presses onto the link, which in turn leads to a displacement of the blocking slide. This displacement is possible in both directions. Due to a corresponding rotation of the drive plate, both a movement of the blocking slide from the unlocking position into the locking position and back from the locking position into the unlocking position can be attained.

Furthermore, in accordance with a preferred development of the invention, the second movement transfer device of the drive plate is a cam contour, the second movement transfer device of the blocking slide is a stop, and the cam contour bears against the stop and slides along the stop when the drive plate and blocking slide are moved relative to each other. The second movement transfer devices can thus exert pressure onto each other, such that, by means of the cam contour of the drive plate, the blocking slide can be brought from the unlocking position into the locking position, but not back, when the drive plate is moved.

In this context it is particularly preferred for the cam contour to bear against the stop via a curved region outside the locking position and to slide along the stop when the drive plate and blocking slide are moved relative to each other, and to bear against the stop via a flat region in the locking position. Here, the curved region ensures that the blocking slide is pushed increasingly further in the direction of the locking position when the drive plate is rotated, wherein it is ensured, when the locking position is reached by the flat region of the cam contour, which bears against the stop, that the drive plate is no longer able to move when a pressure is applied to the blocking slide towards the actuator. Specifically, the pressure on the blocking slide in the direction of the actuator is captured simply by the flat region in the locking position, wherein, due to the absence of a torque provided with a flat surface, no rotation of the drive plate is generated.

In order to form the stop of the blocking slide, which is in contact with the cam contour, different geometric embodiments are possible. In accordance with a preferred development of the invention, however, the stop bears against the cam contour via a curved region. In this way the friction in the event of movements outside the locking position is minimised, whereas in the locking position no rotation of the drive plate can be attained anyhow on account of the flat region of the cam contour, and therefore a manipulation is ruled out.

Furthermore, in accordance with a preferred development of the invention the blocking slide has a locking head, which is provided on the end facing away from the drive plate, and the cam and the link are formed relative to one another such that the cam outside the locking position is in contact with the link at least on one side, and in the event of a movement of drive plate and blocking slide relative to one another slides along the link, and in the locking position, in any case on the side of the cam facing the locking head, is at a distance from the link. Due to this spacing it is ensured that no force can be exerted from the blocking slide onto the drive plate, such that a rotation of the drive plate and therefore also a movement of the blocking slide is inhibited.

Here, in accordance with a preferred development of the invention the link has the form of a slot and the cam is circular in cross section with a straight portion, wherein the straight portion is arranged such that it faces the link in the locking position. This means that, outside the locking position, there is interaction between the cam and link via the circular portion of the outer wall and the cam, whereas in the locking position the straight portion comes into play. This straight portion means, geometrically, that the wall of the cam is distanced further from the link, such that there is thus a distance between the cam and link, whereby the manipulation of the blocking slide is ruled out.

Lastly, in accordance with a preferred development of the invention the width of the slot and the diameter of the cam outside the straight region thereof are coordinated with each other, such that the cam is movable with play within the slot. A pulling and a pushing are thus possible between the cam and slot, wherein, in the locking position, however, a pushing of the link of the blocking slide towards the cam of the drive plate is avoided due to the distance therebetween. This constitutes a means for protection against manipulation.

Figure 2:
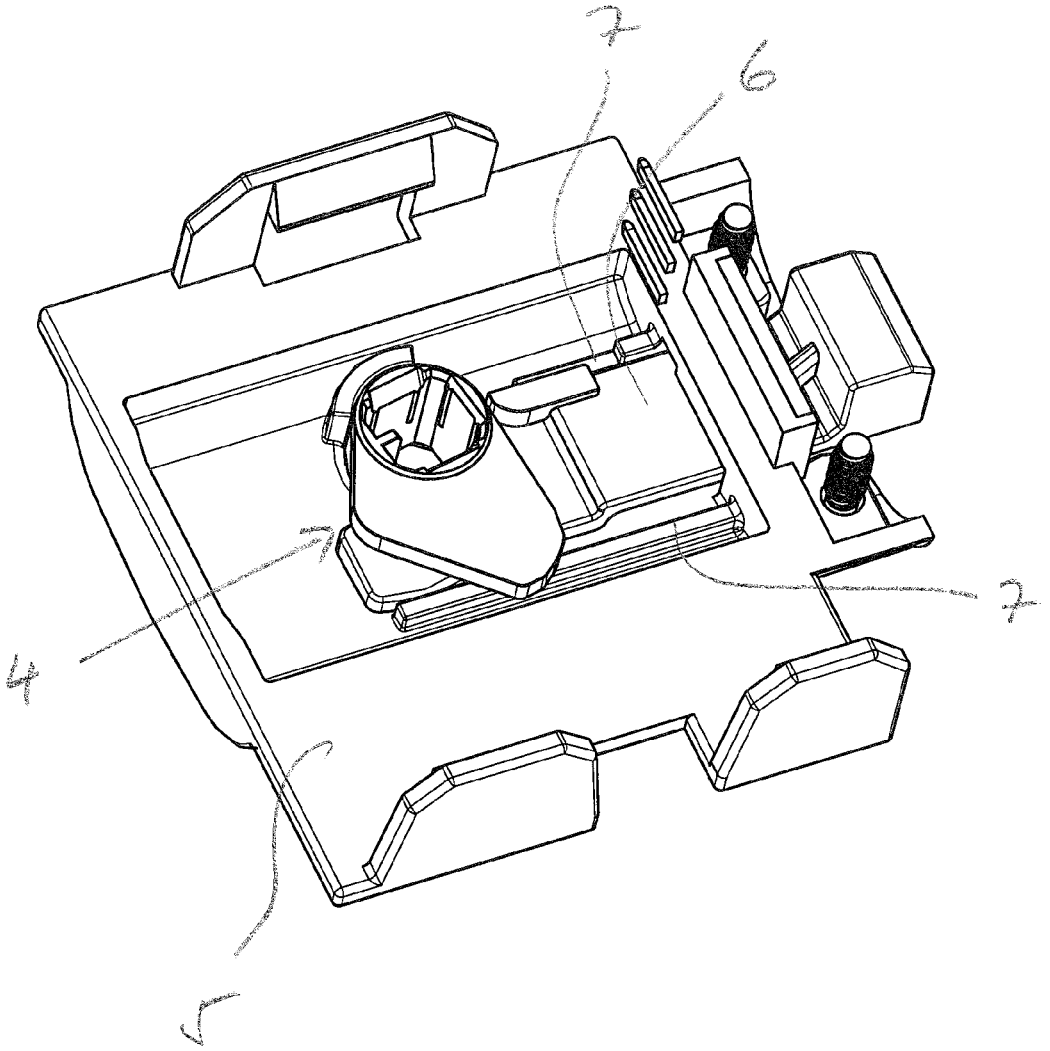
Figure 2A:
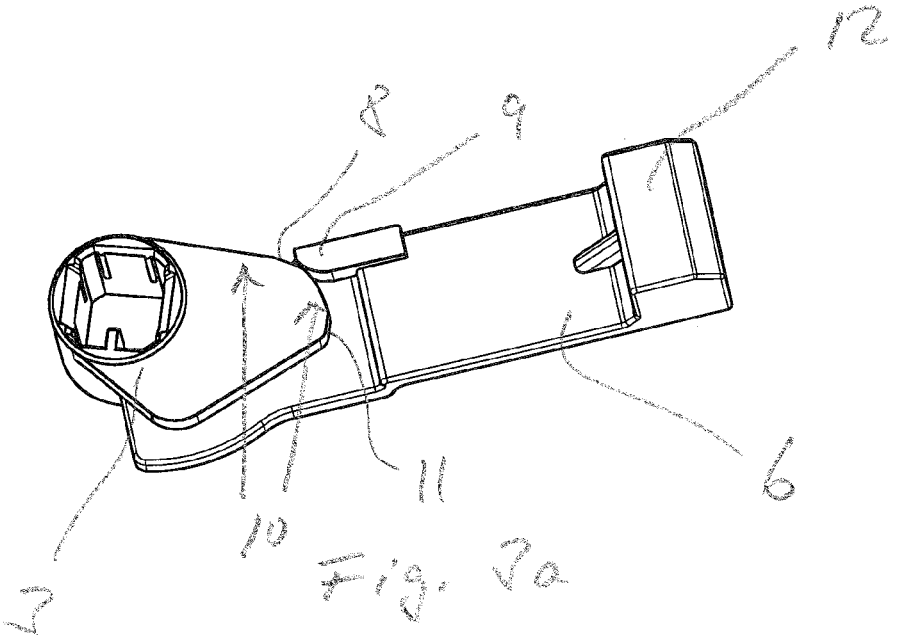
Figure 2B:
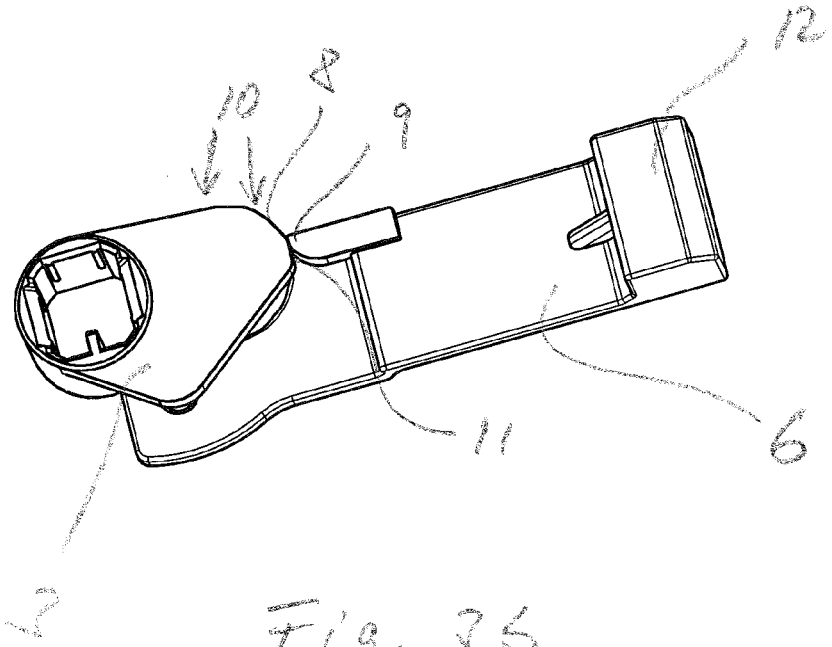
Figure 4A:
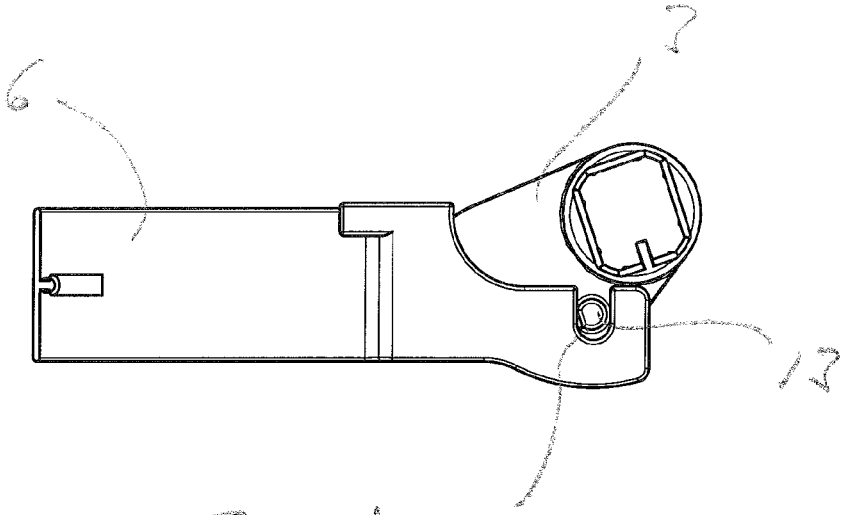
Figure 4B:
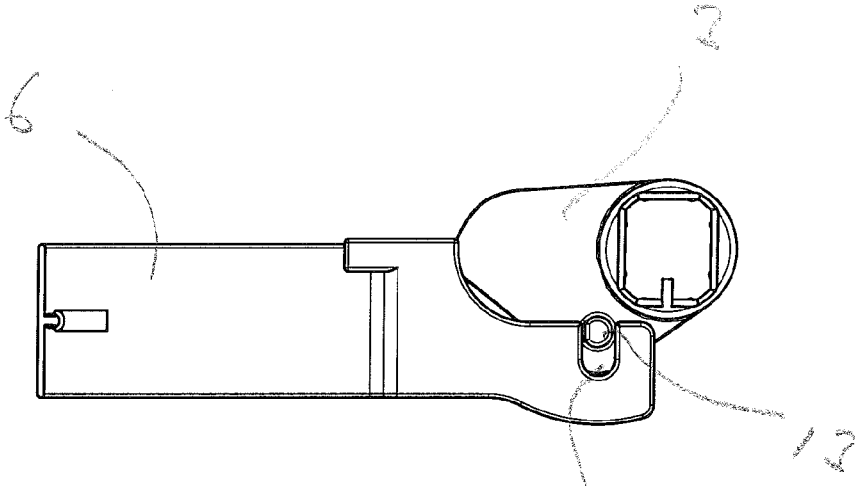
Figure 5:
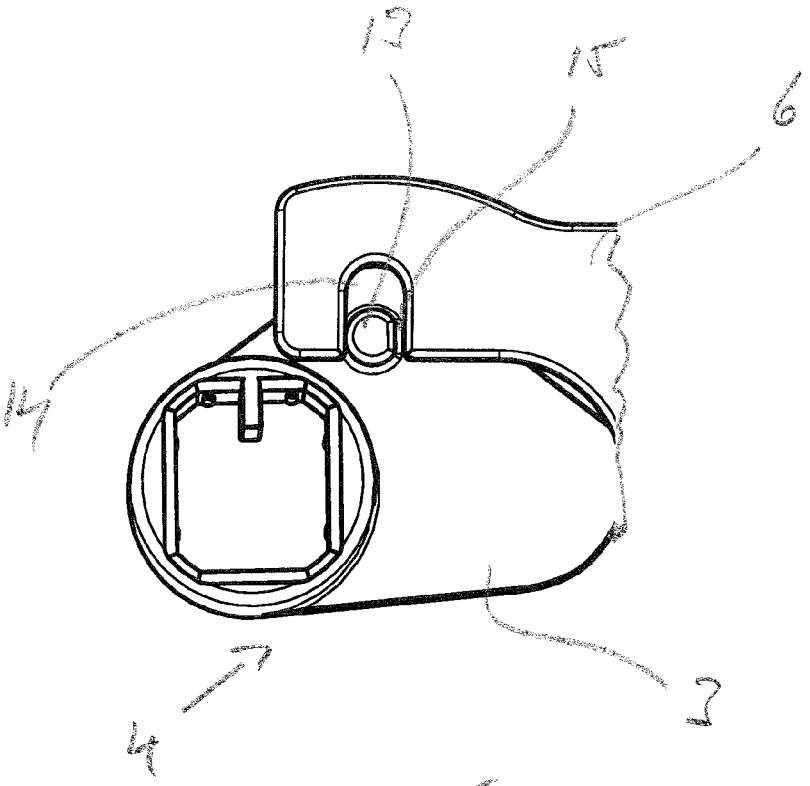

The invention will be explained in greater detail hereinafter on the basis of a preferred exemplary embodiment with reference to the drawing, in which:

FIG. 1 shows part of a locking device for a plug-in connection between a plug (not illustrated in greater detail) and a socket in accordance with a preferred exemplary embodiment of the invention, FIG. 2 shows the accommodation of the part shown in FIG. 1 in a housing together with a blocking slide in accordance with the preferred exemplary embodiment of the invention, FIG. 3*a* shows the interaction between a drive plate and a blocking slide of the locking device in accordance with the preferred exemplary embodiment of the invention outside the locking position from the side on which a cam contour cooperates with a stop, FIG. 3*b* shows the interaction between the drive plate and the blocking slide of the locking device in accordance with the preferred exemplary embodiment of the invention in the locking position from the side on which the cam contour cooperates with the stop, FIG. 4*a* shows the interaction between the drive plate and the blocking slide of the locking device in accordance with the preferred exemplary embodiment of the invention outside the locking position from the side on which a cam cooperates with a link, FIG. 4*b* shows the interaction between drive plate and blocking slide of the locking device in accordance with the preferred exemplary embodiment of the invention in the locking position from the side on which the cam cooperates with the link, and FIG. 5 shows the arrangement of the cam within the link in the locking position in accordance with the preferred exemplary embodiment of the invention in an enlarged illustration.

Part of a locking device for a plug-in connection between a plug (not illustrated in further detail) and a socket in accordance with a preferred exemplary embodiment of the invention can be seen from FIG. 1. The locking device here is part of the socket and has a motor 1, of which the shaft is provided with a detent device 2. A drive plate 3 is latched onto the detent device 2 and, together with the shaft of the motor and the detent device 2, forms an actuator 4 for the locking device.

As can be seen from FIG. 2, the actuator 4 is accommodated in a housing 5, which also accommodates a blocking slide 6. The housing 5 has guide devices 7 for the blocking slide. The blocking slide 6 and the drive plate 3 of the actuator 4 are interconnected, and reference is made in this regard to the figures described hereinafter.

As can be derived from FIGS. 3*a* and 3, the drive plate 3 has a cam contour 8, with which the drive plate interacts with a stop 9 of the blocking slide. The cam contour 8 is formed in such a way that it has a longer curved region 10 and a shorter straight region 11. Due to the rotation of the drive plate 3, the blocking slide is pushed to the right. This movement to the right corresponds to a movement from an unlocking position into a locking position. Although not of further interest for the present invention, it can thus be noted briefly in this regard that the locking function is attained via a locking head 12, which in the locking position prevents a detent hook (not shown here in greater detail) of a charging plug from moving radially, which would enable a detachment of the charging plug from the socket.

The system formed of drive plate 3 and blocking slide 6 can be seen from the other side from FIGS. 4*a* and 4*b*. It can be deduced from these figures that the drive plate 3 has a cam 13, which engages with a link 14 in the blocking slide 6, said link being formed as a slot. Due to a rotation of the drive plate 3, a force is exerted onto the link 14 via the cam 13, such that the blocking slide 6 is movable longitudinally in both directions. Here, it is key, as illustrated in FIG. 5, that with maximum rotation of the drive plate 3, in which case the straight region 11 of the cam contour 8 comes to bear against the stop 9 of the blocking slide 6, a spacing 15 is provided between the cam 13 and the link 14. The cam 13 therefore does not bear against the link 14 in its region facing the locking head 12, since the cam, in its region facing the link in this position in the direction of the locking head 17, is not circular, as it is in the other region, but has a straight portion.

The function of the locking device in accordance with the present exemplary embodiment is then as follows:

When the drive plate 3 of the actuator 4 is driven by the motor 1, the blocking slide 6 is slid forwards in the direction of the locking position until the cam 13 is disengaged. This is ensured by the cam contour 8 on the drive plate 3. During the forwards motion the curved region 10 of the cam contour 8 is in contact with the stop 9, whereas once the locking position has been reached the straight region 11 of the cam contour 8 comes into contact with the stop. In this position the aforementioned spacing 15 is now produced between the cam 13 and the link 14. If it were now attempted to push the blocking slide 5 back from the locking head 12, the corresponding force would be conveyed linearly into the drive shaft, since it is taken up by the straight region 11, which bears against the stop 9 of the blocking slide 6. A movement of the drive plate 3 by rotation or a movement of the blocking slide 6 by displacement therefore is not attained. When the blocking slide 6 is to be unlocked, the drive plate 3 is pushed back with the aid of the motor 1 and in doing so withdraws the blocking slide 6 with the rear side of the cam 13, which now interacts with the link 14.

On the whole, due to the various functions of cam contour 8 and stop 9 on the one hand and also of the cam 13 and the link 14 on the other hand, the rotation of the drive plate 3 always causes a longitudinal movement of the blocking slide 6, whereas no movement and therefore also no unlocking of the locking device is possible by means of a pressure on the blocking slide 6 in the locking position. This is ensured on the one hand by the spacing 15 between the cam 13 and the link 14 in the locked state and also by the straight region 11 of the cam contour 8, which in the locked state bears against the stop 9 of the blocking slide.

LIST OF REFERENCE SIGNS

1 motor
2 detent device
3 drive plate
4 actuator
5 housing
6 blocking slide
7 guide devices
8 cam contour
9 stop
10 curved region
11 straight region
12 locking head
13 cam
14 link
15 spacing

The invention claimed is:

1. A locking device for a plug-in connection between a plug and a socket, comprising:

an actuator configured to rotate about an axis of rotation, the actuator having a drive plate, wherein the drive plate has a first movement transfer device and a second movement transfer device; and a blocking slide configured to be displaced in a longitudinal direction between an unlocking position and a locking position, the blocking slide having a first movement transfer device and a second movement transfer device, wherein the actuator and the blocking slide are configured to interact with each other such that a rotation of the actuator and a longitudinal displacement of the blocking slide are coupled, wherein a longitudinal displacement of the blocking slide coupled with a rotation of the actuator is possible irrespective of a position of the blocking slide, whereas a rotation of the actuator coupled with a longitudinal displacement of the blocking slide is possible only when the blocking slide is displaced outside the locking position, wherein the first movement transfer device of the drive plate interacts with the first movement transfer device of the blocking slide and the second movement transfer device of the drive plate interacts with the second movement transfer device of the blocking slide, and wherein the second movement transfer device of the drive plate comprises a cam contour, wherein the second movement transfer device of the blocking slide comprises a stop, and wherein the cam contour bears against the stop and slides along the stop when the drive plate and blocking slide are moved relative to each other.

2. The locking device according to claim 1, wherein the first movement transfer device of the drive plate and the first movement transfer device of the blocking slide are configured such that in the locking position the drive plate is prevented from being rotated by a displacement of the blocking slide.

3. The locking device according to claim 1, wherein the first movement transfer device of the drive plate comprises a cam, and wherein the first movement transfer device of the blocking slide comprises a link configured to receive the cam.

4. The locking device according to claim 1, wherein the cam contour bears against the stop via a curved region outside the locking position and slides along the stop when the drive plate and the blocking slide are moved relative to each other, and bears against the stop via a flat region in the locking position.

5. The locking device according to claim 1, wherein the stop bears against the cam contour via a curved region.

6. A locking device for a plug-in connection between a plug and a socket, comprising:

an actuator configured to rotate about an axis of rotation, the actuator having a drive plate, wherein the drive plate has a first movement transfer device and a second movement transfer device; and a blocking slide configured to be displaced in a longitudinal direction between an unlocking position and a locking position, the blocking slide having a first movement transfer device and a second movement transfer device, wherein the actuator and the blocking slide are configured to interact with each other such that a rotation of the actuator and a longitudinal displacement of the blocking slide are coupled, wherein a longitudinal displacement of the blocking slide coupled with a rotation of the actuator is possible irrespective of a position of the blocking slide, whereas a rotation of the actuator coupled with a longitudinal displacement of the blocking slide is possible only when the blocking slide is displaced outside the locking position, wherein the first movement transfer device of the drive plate interacts with the first movement transfer device of the blocking slide and the second movement transfer device of the drive plate interacts with the second movement transfer device of the blocking slide, wherein the first movement transfer device of the drive plate comprises a cam, and wherein the first movement transfer device of the blocking slide comprises a link configured to receive the cam, and wherein the blocking slide has a locking head provided on an end facing away from the drive plate, and wherein the cam and the link are disposed relative to one another such that when the blocking slide is outside the locking position, the cam is in contact with the link at least on one side, and in the event of a movement of the drive plate and the blocking slide relative to one another, the cam slides along the link, and when the blocking slide is in the locking position, in any case on the side of the cam facing the locking head, the cam is at a distance from the link.

7. The locking device according to claim 6, wherein the link comprises a slot and the cam is circular when viewed in a cross section and has a straight portion, wherein the straight portion is arranged such that it faces the link in the locking position.

8. The locking device according to claim 7, wherein a width of the slot and a diameter of the cam outside the straight portion are coordinated with each other, such that the cam is movable with a play within the slot.

* * * * *